United States Patent [19]

Denhart

[11] 4,157,731

[45] Jun. 12, 1979

[54] PROTECTIVE HOUSING FOR STRIP HEATERS

[76] Inventor: Norbert J. Denhart, 2845 Westonridge Dr., Cincinnati, Ohio 45239

[21] Appl. No.: 847,831

[22] Filed: Nov. 2, 1977

[51] Int. Cl.[2] ..... F24H 9/04

[52] U.S. Cl. ..... 165/55; 219/366

[58] Field of Search ..... 165/55, 53; 219/366, 219/367, 368

[56] References Cited

U.S. PATENT DOCUMENTS

| | | | |
|---|---|---|---|
| 2,670,935 | 3/1954 | Arnold | 165/55 |
| 2,731,902 | 1/1956 | Debaski | 165/55 X |
| 3,141,499 | 7/1964 | Bunten | 165/55 |
| 3,181,795 | 5/1965 | Phillips | 165/55 X |
| 3,310,652 | 3/1967 | Williams | 165/55 X |
| 3,768,549 | 10/1973 | Goodie | 165/55 |

*Primary Examiner*—Alan Cohan

*Attorney, Agent, or Firm*—John G. Schenk

[57] ABSTRACT

A protective housing is provided with bottom, front, upwardly inclined and depending panels for completely housing the bottom, front and upper portions of a strip heater, said housing being anchored to the floor and upstanding wall along which the strip heater is disposed.

9 Claims, 7 Drawing Figures

PROTECTIVE HOUSING FOR STRIP HEATERS

BACKGROUND OF THE INVENTION

1. Field of the Invention

The field of the invention relates to radiator covers and in particular to a protective housing for strip type heaters.

2. Description of the Prior Art

Applicant is aware of the following patents which are believed to disclose the most pertinent and relevant art, U.S. Pat. No. 2,489,847 to T. L. Arnold discloses a radiator cover fabricated from a single length of sheet metal bent to provide a vertical forward panel 9 and upwardly inclined top panel 11 and a short downturned upper, rear panel 12, said cover being secured relative to a pair of vertically disposed strip heaters 7 by means of upper and lower elongate bolts 13 and 15 which secure portions of the panel to and in abutting relationship with the radiation fins of the strip heater. Any impact to the radiator cover is transmitted directly to and absorbed by the comparatively fragile radiation fins 8 which are secured to and carried by the conduits through which the heating media passes.

U.S. Pat. No. 3,310,652 to H. J. Williams, Jr. discloses a radiator cover which, as best illustrated in FIG. 2, comprises an aluminum extrusion 10 which defines a front wall 12, an upwardly and rearwardly extending upper wall 13 and a bottom wall 14. The upper and lower edges of a back panel 15 are received within elongate slots in the top and bottom walls 13 and 14 for mounting the back panel in spaced relationship with respect to the forward surface of wall W. The front wall is disposed in contacting relationship with panel 33 that is disposed in overlying contacting relationship with the forward edges of each of a plurality of sheet aluminum radiation fins 32, whereby any impact to front wall 12 is transmitted directly to the forward edges of said radiation fins.

U.S. Pat. No. 2,487,407 to T. L. Arnold discloses a radiator housing for a strip heater which comprises an elongate tube 15 to which a plurality of radiation fins 16 are secured. The front wall 19 of the radiator cover is disposed in contacting relationship with the forward edges of the various radiation fins 16, and the lower end of said front wall terminates above and in spaced relationship with reference to the upper surface of floor 7. The cover member includes an upwardly and rearwardly inclined top wall 20 which terminates in a downturned lip 21 which is loosely received within the elongate groove of a hanger strip 13 which is secured to wall 9 by means of nails 14. Impact against forward wall 18 of the cover is transmitted directly to the radiation fins 16.

U.S. Pat. No. 3,448,795 to J. C. McNabney discloses a strip heater which is provided with a protective cover having an integrally formed vertical panel 20 and upwardly and rearwardly inclined top panel 18. The uppermost end of the top panel is shaped as clearly illustrated in FIG. 2 whereby to provide a hinged connection with a horizontal mounting strip 8 which is secured to and carried by vertical wall 2. The lower end of the forward panel is provided with an inturned rearwardly extending portion which terminates in a depending lip 32 which is adapted to engage notched portions 30 of horizontal arms 28 which project forwardly beneath the strip heater. The depending lip 32 of the forward panel 20 is adapted to be received within notches 30 for releasably locking the cover member in a closed, spaced relationship with respect to the strip heaters. The cover member may be pivoted upwardly about its upper end for providing access to the strip heater.

U.S. Pat. No. 3,488,475 to W. Gronwoldt discloses a wall-mounted baseboard housing for an electric heater, wherein the housing includes a rear wall 1 which is secured to the forward surface of a vertical wall, said rear wall, as illustrated in FIG. 2 includes a substantially horizontal forwardly extending panel 12, the rear end of which defines an elongate groove 13 into which the downturned lip 18 of the top panel 17 of a combination top and front wall member is received. The lower end of front wall 5 is inturned at 20 whereby to define an elongate channel for the reception of downturned portion 16 of a slider and holder bracket 2 of the heater tube 16 and its associated radiation fins. The housing comprises 3 separate elements 1, 2 and 5, each of which are fabricated from cast material.

U.S. Pat. No. 2,269,551 to E. G. Powell discloses a radiator enclosure which is hung from its upper end from a mounting bracket 9 which is suitably secured relative to a vertical wall 5. The plurality of latches are provided for facilitating the mounting and/or removal of the enclosure relative to a strip heater, which is located above and in spaced relationship with respect to the floor of the space to be heated. The bottom portion of the elongate tube and radiation fins of the strip heater are open and exposed, as illustrated in FIGS. 2 and 5.

U.S. Pat. No. 2,268,361 to E. R. Walker, et al, disloses a pair of strip heaters 10 and 11 which are housed within a cover member which includes a substantially horizontal top panel and a substantially vertical front panel which includes openings for the in passage of air currents. The rear end of the upper panel terminates in a downturned lip which it can be assumed is anchored to the forward surface of the wall along which the strip heaters extend thereby providing a horizontal surface upon which a person can stand or upon which various articles may be stacked. The front wall is disposed in spaced relationship with respect to the forward edges of the radiation fins, however, since the lower end of the front wall merely abuts the upper surface of the floor, any appreciable impact on the front wall will drive it rearwardly into and against the radiation fins.

The following patents disclose various types of radiator covers, none of which are as relevant to the disclosure of the present invention as those hereinabove discussed: U.S. Pat. No. 2,405,839 to J. Ledwinka, et al.; U.S. Pat. No. 2,487,287 to H. J. Weber, et al.; U.S. Pat. No. 2,631,825 to A. J. Zeitler; U.S. Pat. No. 2,662,747 to R. N. Trane, et al.; U.S. Pat. No. 3,026,393 to D. W. Quirk; U.S. Pat. No. 3,151,671 to R. W. Kritzer; U.S. Pat. No. 3,398,786 to J. C. McNabney.

Applicant is unaware of any prior out covers which have been designed for use with a strip-heater for the purpose of providing a rugged protective housing for a strip-heater which will effectively shield the conductor tube and radiation fins from damage, and which can be associated with existing strip-heater installations without effecting or altering said installations. The subject protective housing is secured directly to the floor and wall along which a strip-heater extends whereby to be entirely free of any contact with the strip-heater which it completely houses.

SUMMARY OF THE INVENTION

Strip-heaters of the type which comprise an elongate, hollow conductor tube, for heating or cooling media, and having a plurality of radiation fins secured to and projecting therefrom, have been in widespread use, particularly in federal housing projects.

Said strip-heaters are easily damaged and their efficiency impaired, if not destroyed, by reason of the intentional or unintentional abuse to which said devices are subjected. It is not uncommon for the radiation fins to be mashed, mutilated, bent and even broken away from the elongate conductor tube to which they were originally secured.

A cover member has been supplied with some strip-heaters for the purpose of providing an elongate horizontal shelf which projects over and immediately above the radiation fins of the conductor tube, for thereby protecting the upper surface of the radiation fins from damage by reason of persons standing on the fins or by reason of articles being placed thereon, however, such covers leave, fully exposed, the forward and lower surfaces of the radiation fins, rendering them easily accessible to damaging impacts.

The abuse to which the radiation fins and their conductor tubes are subjected has created a serious and unbelievably expensive maintenance problem for the owners and/or operators of the housing projects in which such strip-heaters are utilized.

The present invention is directed to the provision of an inexpensive, rugged and durable protective housing which is shaped so as to completely house, and thereby protect, not only the radiation fins and conductor tube of a strip-heater, but also the cover member often associated therewith. The protective housing includes a bottom panel which is adapted to underlie the floor surface below the radiation fins of the conductor tube, an upstanding front panel which is disposed in spaced parallelism with a wall along which the strip-heater is disposed, and an upper and rearwardly inclined panel which projects upwardly and inwardly over the strip-heater and its cover, if a cover is provided, thereby providing an inclined surface which will effectively prevent and preclude articles from being deposited thereon and which will also prevent a child or person from standing on said inclined panel.

The apex of said inclined panel terminates in a downturned, mounting strip which is adapted to be anchored to the vertical surface of the wall along which the strip-heater projects, and the lower panel of the protective cover is adapted to be anchored to the floor beneath and adjacent to the strip-heater for thereby fixedly mounting the protective cover in encompassing relationship with the strip-heater and/or its cover member.

DESCRIPTION OF THE PREFERRED EMBODIMENTS

Figures 1, 2, 3, 4, 5, 6, 7:
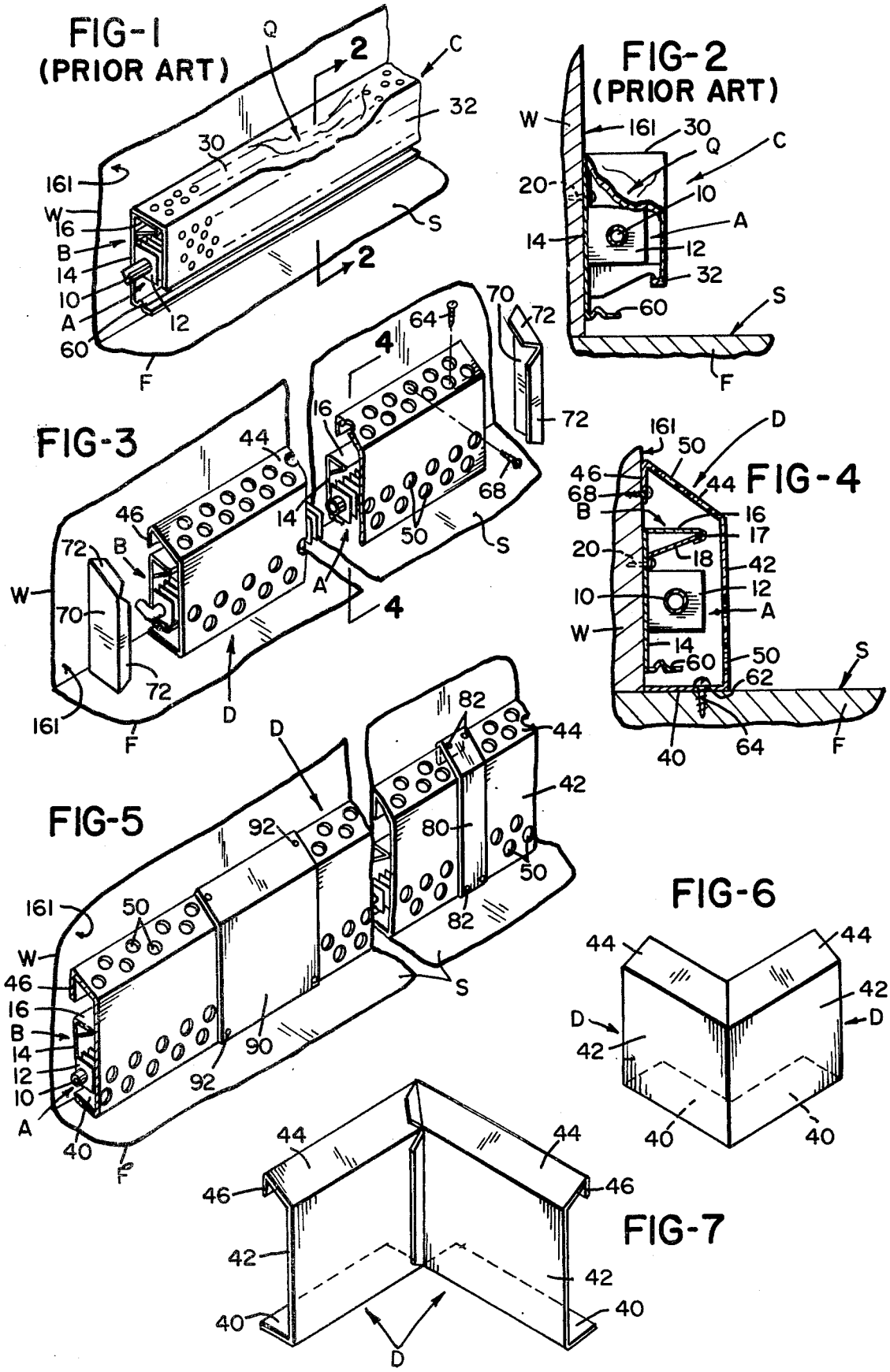
FIG-1 (PRIOR ART)
FIG-2 (PRIOR ART)
FIG. 1 is a perspective view of a typical prior-art strip-heater installation which has been damaged.
FIG. 2 is a sectional view taken on line 2—2 of FIG. 1.
FIG. 3 is a perspective view of the protective housing of the present invention in association with a prior-art strip-heater.
FIG. 4 is a sectional view taken on line 4—4 of FIG. 3.
FIG. 5 is a perspective view of the protective housing of the subject invention illustrating a connector panel and a valve-access panel.
FIG. 6 is a perspective view of an outside corner of the subject housing.
FIG. 7 is a perspective view of an inside corner of the subject housing.

The letter A designates generally a conventional, prior-art, strip-heater of the type which includes an elongate conductor tube 10 to which a plurality of radiation fins 12 are secured in laterally spaced relationship.

A suitable heating or cooling media is adapted to be circulated through conductor tube 10 for thereby imparting a cooling or heating effect to the radiation fins 12. The present invention is neither directed to, nor concerned with the particular structural details of the strip-heater, nor to the manner in which the heater is secured relative to floor F and/or vertical wall W.

The letters B and C indicate generally, typical cover members which, in some instances, are provided or associated with strip-heater A.

Cover member B includes a substantially vertical rear wall 14 which is disposed in contacting relationship with forward surface 161 of wall W. The upper end of rear wall 14 terminates in a forwardly extending, substantially horizontal shelf 16, the forward end 17 of which is maintained in spaced relationship with respect to radiator fins 12 such as, by means of an anchor-strut 18.

In certain instances the cover member B is secured by any suitable means such as a screw 20 to surface 161 of wall W and the conductor tube is suitably supported by means, not illustrated because conventional, which project from wall 14 or from wall W. The lower end of wall 14 is provided with an outturned lip 60 which is disposed in spaced relationship with the upper surface S of floor F, as illustrated.

In FIGS. 1 and 2 I have illustrated the manner in which an additional prior-art cover member C is associated with cover member B in an effort to preclude damage to the strip-heater. Cover member C comprises a flat, horizontal upper wall 30 and a depending front wall 32, wherein the upper wall 30 merely overlies shelf 16 of cover B. When the weight of a heavy object, such as a person, is applied to wall 30 it will crush down, as at Q, distorting shelf 16 and damaging the radiation fins 12.

As clearly evident from FIGS. 1 and 2 the lower portion of the radiation fins are easily accessible whereby to be vulnerable to damage.

With particular reference now to FIGS. 3–5 it will be noted that the protective cover of the subject invention is indicated generally by the letter D, said protective cover comprising a substantially horizontal, bottom panel 40, a substantially vertical front panel 42, the upper end of which terminates in an upwardly and rearwardly inclined top panel 44, the apex of which is downturned to provide a mounting panel 46.

The front panel 42 is provided with a plurality of openings 50, as is the inclined top panel 44.

The bottom panel 40 is adapted to overlie upper surface S of floor F with the rear end 52 thereof underlying outturned lip 60 of the cover member B. The dimensions of bottom panel 40 are such as to completely underlie the conductor tube 10 and the radiation fins 12, whereby to locate front panel 42 forwardly of, and in spaced relationship with respect to the forward surface of radiation fins 12 and forward end 17 of shelf 16 of the cover member B. The upwardly and inwardly inclined panel 44 projects upwardly over and in spaced relationship with respect to the strip-heater A and/or cover member B.

In the preferred embodiment of the invention, bottom panel 40 is provided with openings 62 for the reception of a fastener element such as, by way of example, a screw 64, access to the head of which is provided via openings 50 in front panel 42.

Mounting panel 46 is provided with suitable openings for the reception of a fastener such as a screw 68, the head of which is accessible via opening 50 in panel 44.

From the foregoing, it will be noted that the protective housing D is securely anchored, in spaced, housing-relationship with respect to the strip-heater A and/or its cover member B by reason of the protective housing D being secured to portions of wall W and portions of floor F, thereby preventing convenient access to the strip-heater A and/or its cover member B.

In FIG. 3, the numeral 70 designates end plates which are adapted to be associated with the bottom, front and inclined panels 40, 42 and 44 of the protective housing D such as, by way of example, forwardly projecting lips 72 which are dimensioned to frictionally engage corresponding portions of the inner surface of the bottom, front and inclined panels.

In FIG. 5 the numeral 80 designates a connector panel which is adapted to interconnect and conceal the adjoining ends of adjacent protective housings D. The connector panel is adapted to be secured in place by means of screw fasteners, or the like, 82.

In FIG. 5 the numeral 90 designates an access panel which controls access to a valve, or the like, not illustrated, in conductor 10. The panel is securely though releasably anchored in place by means of screws, or the like, 92.

In FIG. 6 I have illustrated the manner in which two of the protective housings D intersect at an outside corner, whereas in FIG. 7 two housings D intersect at an inside corner with a top panel 44 folded to form a flange 100 and a front panel 42 folded to form a flange 102.

The intersecting housings thus form a corner which is continuous, integral and uninterrupted so that a strip heater disposed on a pair of intersecting walls is completely enclosed in an integral protective housing.

Uniformly satisfactory results have been attained in those instances in which the protective housings D have been fabricated from 22 gauge sheet metal, and wherein the slope of the upwardly inclined panel 44 is at least 40° with reference to horizontal.

The presence of the subject protective housing is such as to effectively prevent damage to the strip-heater by reason of heavy objects including persons resting or standing on the inclined panel 44, the slope of which is such as to cause any object placed thereon to slide off, and the structural details and relationship of front panel 42 and bottom panel 40 are such as to lend rigid support to the inclined panel whereby to prevent it from being bent or damaged by items placed thereon, and the relationships of the inclined panel 44 and bottom panel 40 to the front panel 42 are such as to preclude the caving-in of said front panel by blows or impacts directed thereagainst.

Since the front panel 42 extends to surface S of floor F it is impossible for a tenant to reach the radiation fins 12 from the bottom of the housing.

The operating efficiency of the space heater is unimpaired by reason of the protective cover member, since air is free to circulate through openings 50 in front panel 42 and through openings 50 in the upwardly and inwardly inclined top panel 44.

From the foregoing, it will be noted that I have thus provided simple, rugged and highly effective means in the form of a protective housing for precluding damage and convenient access to a strip-heater.

What is claimed is:

1. A protective housing for a strip heater of the type which includes an elongate conductor tube having a plurality of laterally spaced fins thereon, the housing comprising:

a plurality of elongate sections each of said plurality of sections including a single unitary elongate protective cover having opposite ends, opposite longitudinal sides, a longitudinal axis and a transverse axis, said protective cover being bent along said longitudinal sides toward said longitudinal axis to include a vertical front panel disposed in front of and spaced from strip heater fins, a horizontal bottom panel joined to said front panel along a bottom edge of said front panel by a first bend in said cover and disposed beneath and spaced from a strip heater fins and extending from said front panel to a wall on which a strip heater is mounted, an upwardly inclined top panel joined to said front panel along a top edge of said front panel by a second bend in said cover and disposed above and spaced from a strip heater fins and extending from said front panel to a wall on which a strip heater is mounted, a vertical mounting panel joined to said top panel along a rear edge of said top panel so that a strip heater is completely housed in spaced relationship with and within the protective housing;

at least one of said protective covers having the top panel thereof bent along one end toward said transverse axis and having the front panel thereof bent along said one end toward said transverse axis to form a right angle, with front and top panels respectively of an adjacent one of said protective covers being joined directly to said bent top and front panel ends to form a corner which is continuous, integral and uninterrupted so that a strip heater disposed on a pair of intersecting walls is completely enclosed in an integral protective housing;

a plurality of vent openings defined in said front panel near said first corner;

a plurality of vent openings defined in said top panel, said vent openings permitting passage of air to and from a strip heater enclosed by the protective housing;

fastening means attaching said bottom and mounting panels to a floor and a wall, respectively, said vent openings being located to provide access to said fastening means via said vent openings.

2. A protective housing as called for in claim 1, wherein the slope of the inclined top panel is such as to prevent a person from standing thereon.

3. A protective housing as called for in claim 1, wherein the slope of the inclined top panel is such that articles placed thereon will slide off unless fastened thereto.

4. A protective housing as called for in claim 1, wherein the slope of the inclined top panel is at least 40° from horizontal.

5. A protective housing as called for in claim 1, wherein the front and upwardly inclined top panels include openings for the passage of air to and from the enclosed strip-heater.

6. A protective housing as called for in claim 1, wherein the relationship between the upper and lower edges of the upwardly inclined top panel, and the relationship between the upper and lower ends of the front panel are such as to reinforce said panels against distortion when subjected to impact, whereby the effect of impact against either of said panels is shielded from transmittal to the enclosed strip-heater.

7. A protective housing as called for in claim 1, wherein adjacent ends of adjoining housings are disposed in axial alignment, and wherein the end-adjacent portions of said adjacent housings are interconnected by a connector panel which includes a front panel the upper end of which terminates in an upwardly and rearwardly inclined top panel the upper end of which terminates in a downturned mounting panel, the said panels of the connector panel corresponding to the front, inclined top and mounting panels of the protective housings, and means securing said connector panel to corresponding portions of adjoining housings.

8. A protective housing as called for in claim 1, wherein adjacent ends of adjoining housings are disposed at substantial right angles to provide a continuous protective housing for a strip-heater disposed along the outside of a pair of intersecting walls.

9. A protective housing as called for in claim 1, wherein the adjacent ends of adjoining housings are disposed at substantial right angles to provide a continuous protective housing for a strip-heater disposed along the inside of a pair of intersecting walls.

* * * * *